US006029853A

United States Patent [19]

Kubo et al.

[11] Patent Number: 6,029,853

[45] Date of Patent: Feb. 29, 2000

[54] DISPERSING METHOD, DISPERSING APPARATUS AND DISPERSING SYSTEM HAVING DISPERSING APPARATUS

[75] Inventors: Nobuaki Kubo, Hirakata; Mitsuaki Ito, Osaka; Masakazu Inoue, Tokyo, all of Japan

[73] Assignees: Nippon Paint Co., Ltd.; Inoue Mfg., Inc., both of Japan

[21] Appl. No.: 09/027,094

[22] Filed: Feb. 20, 1998

[30] Foreign Application Priority Data

Aug. 25, 1997 [JP] Japan ..... 9-241717

[51] Int. Cl.[7] ..... B67B 7/00

[52] U.S. Cl. ..... 222/1; 222/190; 222/204; 222/232; 222/236; 222/237; 222/136; 222/139; 222/410

[58] Field of Search ..... 222/190, 204, 222/232, 236, 237, 318, 333, 334, 335, 136, 139, 410

[56] References Cited

U.S. PATENT DOCUMENTS

| | | | |
|---|---|---|---|
| 2,017,867 | 10/1935 | Nantz | 222/136 |
| 3,095,121 | 6/1963 | Douty et al. | 222/52 |
| 3,244,328 | 4/1966 | Brown | 222/136 |
| 3,717,285 | 2/1973 | Hatton | 222/136 |
| 4,082,227 | 4/1978 | McGrane et al. | 239/675 |
| 4,335,994 | 6/1982 | Gurth | 415/90 |
| 4,391,390 | 7/1983 | Howard | 22/136 |
| 4,514,139 | 4/1985 | Gurth | 415/90 |
| 4,773,819 | 9/1988 | Gurth | 415/90 |

FOREIGN PATENT DOCUMENTS

| | | | |
|---|---|---|---|
| 07116488 | 5/1995 | Japan | 222/136 |
| 7-116488 | 5/1995 | Japan . | |

*Primary Examiner*—Kevin Shaver
*Assistant Examiner*—David Deal
*Attorney, Agent, or Firm*—Adams & Wilks

[57] ABSTRACT

A dispersing system comprises a dispersing apparatus, a storage tank for storing a dispersing medium and a liquid containing a material to be treated, and conduits for connecting the dispersing apparatus in fluid communication with the storage tank. The dispersing apparatus comprises a dispersing chamber, at least one rotationally driven disc, a suction inlet through which the liquid containing the material to be treated and the dispersing medium are drawn from the storage tank into the dispersing chamber by the suction created by rotation of the disc, a discharge outlet, and a medium-separating device for separating the dispersing medium from the liquid containing the dispersed material and selectively discharging the liquid containing the dispersed material but not the dispersing medium from the discharge outlet. During a dispersing treatment, the liquid containing the material to be treated and the discharge medium are drawn by suction from the storage tank into the dispersing chamber through one of the conduits by the rotation of the disc. The dispersing medium is then circulated within the dispersing chamber by the rotation of the disc to disperse the material to be treated in the liquid. Thereafter, the liquid containing the dispersed material but not the dispersing medium is discharged from the discharge outlet while the dispersing medium is separated from the liquid containing the dispersed material. During cleaning of the storage tank, the dispersing chamber and the conduits, the dispersing medium is permitted to flow out of the dispersing chamber together with the cleaning fluid.

20 Claims, 3 Drawing Sheets

DISPERSING METHOD, DISPERSING APPARATUS AND DISPERSING SYSTEM HAVING DISPERSING APPARATUS

BACKGROUND OF THE INVENTION

1. Field of the Invention

The present invention relates generally to a dispersing method, a dispersing apparatus and to a dispersing system having the dispersing apparatus and, more particularly, to a dispersing method, apparatus and system by which a material to be treated is finely ground and dispersed using a dispersing medium. The dispersing method, apparatus and system are characterized by supplying the material to be treated and the dispersing medium and by cleaning the dispersing apparatus after dispersion treatment.

2. Background Information

Medium-dispersing apparatuses of various types have been employed for the production of various products such as coating materials, printing ink, pigments and magnetic materials. In the foregoing medium-dispersing apparatuses, agitating motion is applied by an agitating means disposed in a dispersing chamber to a mixture of a dispersing medium and a material to be treated. The material to be treated is then finely ground by pulverization, shearing action and grinding action generated between the media to uniformly disperse the material in a liquid. If such an apparatus is designed so that adequate treatment time may be obtained for efficient dispersion, the dispersing chamber tends to be large and cannot be economically applied for the production of a small amount of product.

Further, the dispersing chamber in the foregoing medium-dispersing apparatuses is of a vertical-type or a horizontal-type, and a dedicated liquid-feeding pump is required to feed the material to be treated into the dispersing chamber. This is because when a non-dedicated liquid-feeding pump is used, if the dispersing medium flows out of the dispersing chamber and enters into the pump, the pump tends to jam, and if an outflow-preventing mechanism is provided to prevent outflow of the dispersing medium, such a mechanism is not completely cleaned after the dispersion treatment, thereby resulting in further problems when the apparatus is used to treat different materials.

Moreover, prior to the dispersion treatment, a predetermined amount of the dispersing medium is required to be charged uniformly into the dispersing chamber. However, this charging operation is troublesome, for example, depending on the structure of the dispersing apparatus, since the charging operation is necessarily required to be performed in several operations, resulting in a long charging time and sometimes in poor operability of the apparatus.

In the cleaning operation after completion of the dispersion treatment or at the time of changing the types of materials, the dispersing chamber and production lines have to be cleaned, and the dispersing medium has to be discharged from the dispersing chamber for cleaning. However, the operation for discharging the dispersing medium cannot be readily carried out. Further, solid or liquid stains adhere to corner portions of pipelines of the production line, whereby the cleaning operation is incomplete and a large amount of cleaning liquid is required. Accordingly, the types of products which can be treated by one medium-dispersing apparatus is fixed, and the range of application by one apparatus is restricted.

A dispersing apparatus has been known which utilizes a rotary disc-type dispersing device for dispersion-treating a small amount of a material to be treated without using the conventional dispersing chamber and pump, thereby eliminating jamming of the dispersing medium. (See Japanese Unexamined Patent Publication No. 7-116488). In this dispersing apparatus, the dispersing medium is first charged into a dispersing chamber. The material to be treated is then drawn in by suction from a tank into the dispersing chamber by rotation of a disc. A dispersion treatment is performed by rotating the disc to mix the dispersing medium and the material to be treated in the dispersing chamber. A filter is fixed to an inner circumferential surface of the dispersing chamber leading to a delivery port and allows the dispersed material but not the dispersing medium to pass therethrough. By this construction, only the dispersed material is permitted to flow from the dispersing chamber back to the tank through a pipeline connecting the delivery port of the dispersing chamber in fluid communication with the tank. During a cleaning operation, the dispersing medium is removed from the dispersing chamber.

However, problems similar to those of the foregoing conventional techniques have sometimes occurred with the dispersing apparatus disclosed in Japanese Unexamined Patent Publication No. 7-116488 with respect to the charging of the dispersing medium, the discharging during cleaning operations, or the cleaning of pipelines of the production line.

SUMMARY OF THE INVENTION

It is an object of the present invention to provide a dispersion method which uses a dispersing apparatus for generating suction by the rotation of at least one disc of a rotary disc-type dispersing device. According to the present invention, during the dispersion of a material in a liquid by means of a dispersing medium, the dispersing medium can readily be charged, and after completion of the dispersion treatment, discharge of the dispersing medium and cleaning of pipelines can be conducted effectively.

Another object of the present invention is to provide a dispersing apparatus for the dispersion method.

Another object of the present invention is to provide a dispersing system having the dispersing apparatus.

The foregoing and other objects of the present invention are carried out by a dispersing method comprising the steps of charging a dispersing medium and a liquid containing a material to be treated into a tank, drawing the liquid containing the material to be treated and the dispersing medium into a dispersing chamber by suction generated by rotation of at least one rotary disc disposed in the dispersing chamber, constraining the dispersing medium within the dispersing chamber by means of a medium-separating means, dispersing the material in the liquid by movement of the dispersing medium by the rotation of the disc, discharging the dispersed liquid through a discharge outlet of the dispersing chamber while separating the dispersing medium from the dispersed liquid by means of the medium-separating means disposed at the discharge outlet side of the dispersing chamber, circulating the dispersed liquid to the tank through a pipeline which communicates the discharge outlet with the tank and, after the dispersion treatment, cleaning the tank, the dispersing chamber and the pipeline by permitting the dispersing medium to flow out of the dispersing chamber through the discharge outlet and to circulate together with a cleaning liquid through the tank, the dispersing chamber and the pipeline.

In another aspect, the present invention is directed to a dispersing apparatus comprising a dispersing chamber, at least one rotationally driven disc disposed in the dispersing chamber, a suction inlet for drawing the dispersing medium and the liquid containing the material to be treated into the dispersing chamber by suction created by rotation of the disc, moving means for displacing the dispersed medium so as to disperse the material in the liquid, a discharge outlet for discharging from the dispersing chamber the liquid containing the dispersed material, and medium-separating means disposed at an inner side of the discharge outlet for separating the dispersing medium from the liquid containing the dispersed material and permitting the liquid containing the dispersed material but not the dispersing medium to be discharged from the dispersing chamber.

In another aspect, the present invention is directed to a dispersing system for carrying out the dispersing method according to the present invention. The dispersing system comprises a storage tank, a dispersing apparatus and conduit means for connecting the storage tank and the dispersing apparatus in fluid communication. The storage tank stores a dispersing medium and a liquid containing a material to be treated and has an inlet port and an outlet port. The dispersing apparatus has a dispersing chamber, at least one rotationally driven disc disposed in the dispersing chamber, a suction inlet for drawing the dispersing medium and the liquid containing the material to be treated from the storage tank into the dispersing chamber by suction created by rotation of the disc, moving means for displacing the dispersing medium so as to disperse the material in the liquid, a discharge outlet for discharging from the dispersing chamber the liquid containing the dispersed material, and medium-separating means disposed at an inner side of the discharge outlet for separating the dispersing medium from the liquid containing the dispersed material. The conduit means connects the suction inlet and the discharge outlet of the dispersing apparatus in fluid communication with the outlet port and the inlet port, respectively, of the storage tank.

BRIEF DESCRIPTION OF THE DRAWINGS

FIGS. 5(A) and 5(B) show another embodiment of the discharge outlet portion of the dispersing apparatus according to the present invention, wherein FIG. 5(A) is a view illustrating the case where a dispersed liquid is discharged through a medium-separating means and FIG. 5(B) is a view illustrating the case where a dispersing medium is discharged.

DETAILED DESCRIPTION OF THE PREFERRED EMBODIMENTS

The preferred embodiments of the present invention will be described below with reference to FIGS. 1–5, wherein like numerals designate like elements throughout the various figures.

Figure 1:
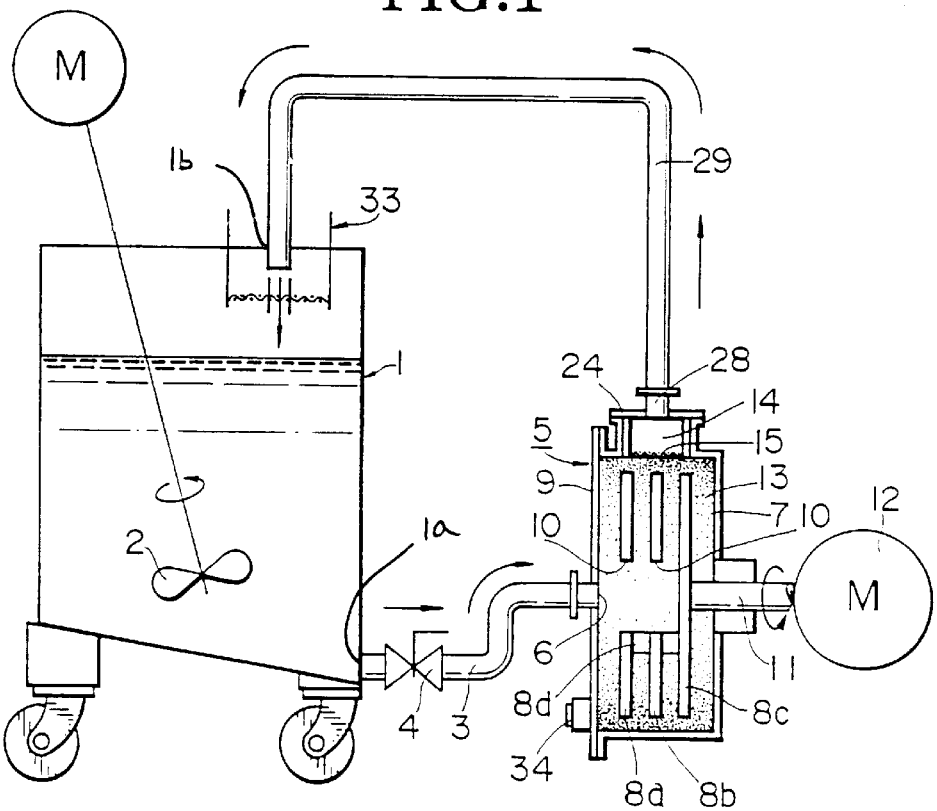
FIG. 1 is a layout diagram illustrating the basic construction of a dispersing system and dispersing apparatus according to the present invention.

As shown in FIG. 1, a tank 1 for storing a liquid containing a material to be treated, such as a slurry, and a dispersing medium, is provided with a stirring device having an agitating blade 2 for stirring and mixing the contents of the tank. A conduit or pipeline 3 connected to an outlet port 1*a* disposed at a lower portion of the tank 1 is connected in fluid communication with a suction inlet 6 of a dispersing apparatus 5 through a valve 4. A conduit or pipeline 29 connects a discharge outlet 14 disposed at an upper portion of the dispersing apparatus 5 in fluid communication with an inlet port 1*b* disposed at an upper portion of the tank 1. The tank 1, the dispersing apparatus 5 and the pipelines 3,29 define a dispersing system for carrying out a dispersing method according to the present invention as further described below.

Figure 2:
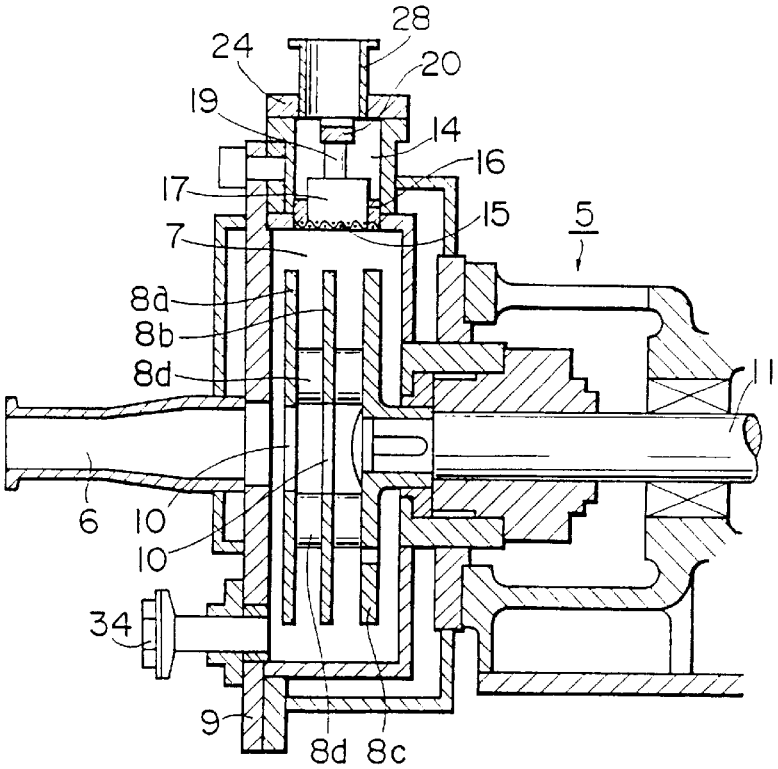
FIG. 2 is a sectional view showing one embodiment of a dispersing apparatus according to the present invention.

The dispersing apparatus 5 has a structure basically the same as the rotary disc-type dispersing apparatus described in the above-mentioned Japanese Unexamined Patent Publication No. 7-116488. As shown in FIGS. 1 and 2, the dispersing apparatus 5 comprises a plurality of rotary discs 8*a*,8*b*,8*c* disposed within a dispersing chamber 7 of generally cylindrical shape. A hole 10 is formed through the center portion of the discs 8*a*,8*b* at the side of the suction inlet 6 which opens at a center portion of a side plate 9 of the dispersing apparatus 5. Connecting members 8*d* are disposed at circumferentially spaced locations around the holes 10 to integrally connect the discs 8*a*,8*b*,8*c* in spaced-apart relation. The disc 8*c* is connected to an actuating shaft 11 which is rotated by a motor 12 to rotate the discs 8*a*,8*b*,8*c* as a unit. By the rotation of the discs 8*a*,8*b*,8*c*, the liquid containing the material to be treated and the dispersing medium which are in contact with the surface of the discs is thereby made to flow in a circumferential and radial outward direction by friction and centrifugal force to generate suction in the region of the holes 10, whereby the liquid containing the material to be treated and the dispersing medium are drawn in by suction into the dispersing chamber through the suction inlet 6.

A dispersing medium 13 comprises a grinding medium, such as glass beads, ceramic beads or steel balls, which is charged in a predetermined amount into the tank 1 and drawn in by suction into the dispersing chamber through the suction inlet 6 when the discs 8*a*,8*b*,8*c* are rotated as mentioned above. The supply of the dispersing medium 13 may be supplemented without stopping the operation of the dispersing apparatus. Thus, in the dispersing chamber 7, motion is imparted to the dispersing medium 13 by means of the rotating discs 8*a*,8*b*,8*c*. The distance between the respective discs 8*a*,8*b*,8*c* and the distance between each disc and the inner wall of the dispersing chamber is suitably selected and maintained in relation to the size of the dispersing medium 13 to ensure that the dispersing medium does not become jammed or cause breakage of any parts during operation of the dispersing apparatus.

As further described below, the material to be treated is dispersed in the liquid by the dispersing medium 13 in the dispersing chamber 7. The liquid containing the dispersed "Dispersing" the material to be treated means grinding particles of the material and dispersing the particles in the liquid. Stated otherwise, after the particles are ground, the particles are mixed in the liquid. The material to be treated is ground by the grinding medium when the material and the grinding medium are agitated by the rotating discs 8*a*, 8*b*, 8*c* material (hereinafter referred to as "dispersed liquid") is discharged from the dispersing chamber 7 through the discharge outlet 14 of the dispersing apparatus 5. In this embodiment, the discharge outlet 14 is generally square-shaped in cross-section. At an inner side of the discharge outlet 14, a medium-separating means for separating the dispersed liquid from the dispersing medium is provided. In the embodiment shown in FIGS. 1 to 4, the medium-separating means is detachably connected to the dispersing chamber 7 so that the medium-separating means may be attached to the dispersing chamber during a dispersion treatment, and may be detached from the dispersing chamber during a cleaning operation after completion of the dispersion treatment. In another embodiment, the medium-separating means is fixedly connected to the dispersing apparatus 5 at the discharge outlet 14 and may be placed between an operation position and a non-operation position within the dispersing chamber 7 to open and close a flow path for permitting the dispersing medium 13 to flow, as shown in FIGS. 5(A) and 5(B).

Figure 3:
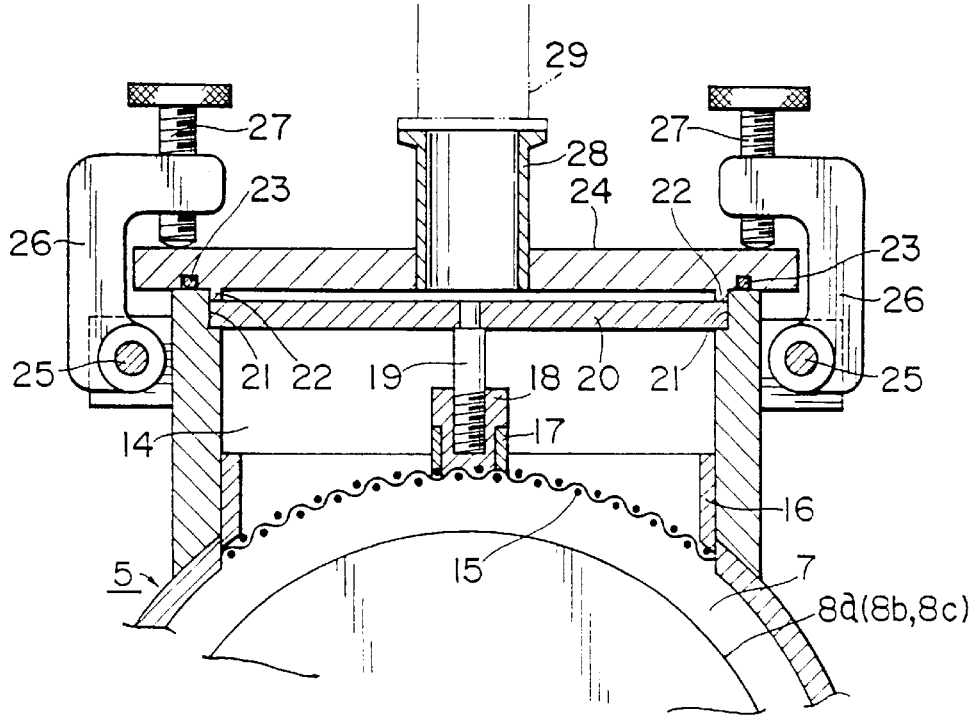
FIG. 3 is an enlarged cross-sectional view of the discharge outlet portion of the dispersing apparatus shown in FIG. 2.
Figure 4:
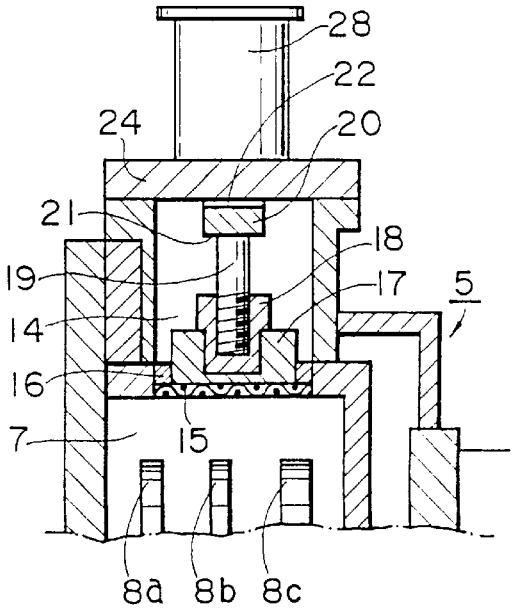
FIG. 4 is an enlarged vertical-sectional view of the discharge outlet portion of the dispersing apparatus shown in FIG. 3.
Figure 5:
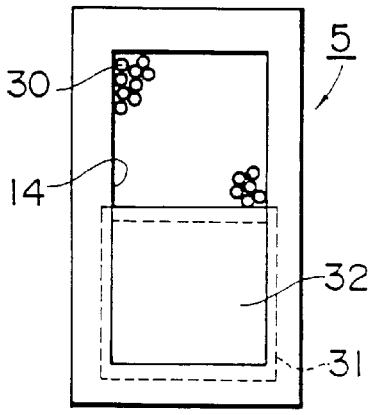
Figure 5:
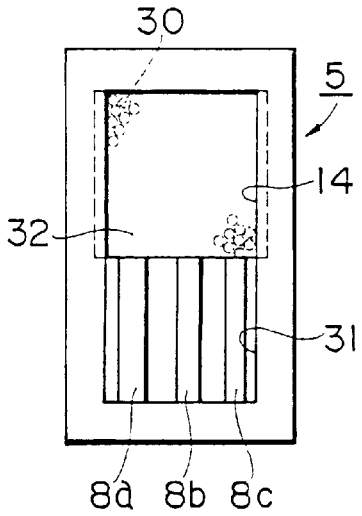

As the medium-separating means, a suitable separating system, such as a screen system, a cassette screen system or a gap separator system, may be used. FIGS. 1–4 show an embodiment of the medium-separating means comprising a screen system in the form of a filter 15 having slits, pores or mesh openings, through which the dispersed liquid but not the dispersing medium 13 may pass. The filter 15 is formed having a preselected shape along the inner surface of a the dispersing chamber 7, and the filter 15 is supported by a holding frame 16 which is detachably engaged with the discharge outlet 14. The holding frame 16 is integrally connected to the filter 15 at a circumferential surface thereof by suitable connecting means such as, for example, weld or connecting bolts. As best seen in FIGS. 3–4, a stay 17 is fixed to a generally central portion of the holding frame 16, a connection rod 19 is threadedly connected at one end thereof to a securing portion 18 disposed on the stay 17, and a securing frame 20 is fixed to the other end of the connection rod 19. The securing frame 20 is detachably fitted in receiving grooves 21,21 formed at a downstream end of the discharge outlet 14, and the holding frame 16 is thereby held within the discharge outlet 14.

A cover plate 24 is mounted at the downstream end of the discharge outlet 14 and has, on its lower surface, a seal 23 and small projections 22,22 which fit into the receiving grooves 21,21 and press the securing frame 20 tightly in place. The cover plate 24 is tightened down by a fastening screw 27 of a clamp 26 which is hinged by a hinge 25 to the dispersing chamber 7 (FIG. 3). The cover plate 24 is provided with a discharge conduit or pipeline 28 detachably connected to the pipeline 29 in fluid communication therewith. The dispersed liquid discharged from the discharge outlet 14 is discharged through the discharge pipeline 28, passes through the pipeline 29, and is circulated to the tank 1.

In the state as shown in the drawings, when the cover plate 24 is detached by loosening the clamp 26, and then the securing frame 20 or the like is removed from the discharge outlet 14, the medium-separating means will be detached or removed from the dispersing chamber 7 to permit the dispersing medium 13 to flow out of the dispersing chamber 7 after the cover plate 24 is re-attached by operating the clamp 26 and the motor 12 is actuated to rotate the discs 8*a*,8*b*,8*c*. To attach the medium-separating means, the cover plate 24 is detached by loosening the clamp 26, the securing frame 20 is fitted in the receiving grooves 21,21 at the downstream end of the discharge outlet 14, and the cover plate 24 is re-attached by operating the clamp 26 to tighten the securing frame 20 and attach the medium-separating means to the discharge outlet 14, thereby permitting only the dispersed liquid to flow out of the dispersing chamber 7 while separating and retaining within the dispersing chamber the dispersing medium 13.

FIGS. 5(A) and 5(B) show another embodiment of the discharge outlet portion of the dispersing apparatus according to the present invention where the medium-separating means is fixedly disposed at the discharge outlet 14 of the dispersing apparatus 5. At a part of the discharge outlet 14, a filter 30 having, for example, slits, pores or mesh openings dimensioned to permit the dispersed liquid but not the dispersing medium 13 to pass therethrough, is formed along the inner surface of the dispersing chamber 7. A flow path 31 along which the dispersing medium flows is formed at the side portion of the filter 30, and closing means is provided for selectively opening and closing the flow path 31. In this embodiment, the closing means comprises a closure plate 32 slidably disposed in front of the filter 30 and the flow path 31. When the flow path 31 is closed by the closure plate 32, the dispersed liquid is discharged through the filter 30 (FIG. 5(A)), and the dispersing medium 13 in the dispersing chamber 7 is prevented from flowing out. When the closure plate 32 is moved to open the flow path 31, the dispersing medium 13 can be discharged from the dispersing chamber 7 (FIG. 5(B)). The closure plate 32 can be moved by an operator to selectively open and close the flow path 31 as described above.

Referring again to FIG. 1, the terminal end of the pipeline 29 is connected to the inlet port 1*b* of and opens into the tank 1, and a collecting filter 33 having, for example, slits, pores or mesh openings is provided at the terminal end so that a cleaning liquid can circulate while the dispersing medium can be collected. When it is desired to circulate the dispersing medium, the collecting filter 33 is removed from its position against the terminal end of the pipeline 29, whereas when the dispersing medium is to be collected, the collecting filter 33 is set in position against the terminal end of the pipeline 29 as shown in FIG. 1.

During a dispersion treatment according to the present invention, a liquid containing material to be treated and the dispersing medium 13 are charged into the tank 1 and then the motor 12 is actuated to rotate the discs 8*a*,8*b*,8*c*. By the rotation of the discs 8*a*,8*b*,8*c*, the liquid containing the material to be treated and the dispersing medium 13 are drawn by suction from the tank 1 into the dispersing chamber 7 through the pipeline 3. The material to be treated is thoroughly and uniformly dispersed in the liquid by the dispersing medium 13 which is circulated within the dispersing chamber 7 by the rotation of the discs 8*a*,8*b*,8*c*. The dispersed liquid is then discharged from the discharge outlet 14 and returned to the tank 1 through the pipeline 29, while the dispersing medium remains in the dispersing chamber 7 by the separating action of the medium-separating means. By the circulation system as described above, the material to be treated is dispersion-treated to a predetermined degree and is thereafter removed from the tank 1 through a pipeline not shown in the drawings.

After completion of the dispersion treatment, the motor 12 is stopped, and any liquid remaining in the dispersing chamber 7 or the pipeline 29 is discharged through a plug valve 34 disposed on the side plate 9 at the base of the dispersing chamber 7. The medium-separating means is then removed from the discharge outlet 14 as described above (FIGS. 1–4) or the flow path 31 is opened for permitting the dispersing medium 13 to flow (FIGS. 5(A),5(B)), and the circulation system is readied for use again. Then cleaning liquid is charged into the tank 1, and the dispersing apparatus 5 is again operated to draw the cleaning liquid into the dispersing chamber 7 by suction. Thereafter, the dispersing medium 13 in the dispersing chamber 7 is discharged from the dispersing chamber together with the cleaning liquid and both are circulated through the system by which the dispersing medium is itself cleaned. At the same time, by permitting the dispersing medium 13 to flow to all the corners of the tank 1, the dispersing chamber 7, the pipeline 29 and the like, stains or the like that may be adhered to corner portions of the flow line can be removed by cleaning. After completion of the cleaning operation, the collecting filter 33 is set in position against the terminal end of the pipeline 29 to collect the dispersing medium 13 flowing in the pipeline 29.

According to the present invention, the dispersion method comprises charging a dispersing medium and a liquid containing a material to be treated into a tank, drawing in the liquid containing the material to be treated and the dispersing medium through a suction inlet into a dispersing chamber by suction generated by rotation of at least one disc which is disposed in the dispersing chamber, constraining the dispersion medium within the dispersing chamber by a medium-separating means, uniformly dispersing the material in the liquid by displacing the dispersing medium by the rotation of the disc, discharging the dispersed liquid through a discharge outlet while separating the dispersing medium from the dispersed liquid by means of the medium-separating means, circulating the dispersed liquid to the tank through a pipeline which communicates the discharge outlet with the tank and, after completion of the dispersion treatment, cleaning the tank, the dispersing chamber and the pipeline by permitting the dispersing medium to flow out of the dispersing chamber through the discharge outlet and circulate together with a cleaning liquid through the tank, the dispersing chamber and the pipeline. By this dispersion method, the dispersing medium need not be charged directly into the dispersing chamber at the start but can be charged into the tank and drawn into the dispersing chamber by suction generated by the rotating disc, whereby the charging operation of the dispersing medium can readily be conducted.

Further, by the structure of the dispersing system and apparatus according to the present invention, after completion of the dispersion treatment, the dispersing medium is permitted to flow from the discharge outlet of the dispersing chamber and to circulate through the tank and the dispersing chamber by means of pipelines, and the dispersing medium can simply be discharged from the dispersing chamber and be circulated in the flow line together with the cleaning liquid, whereby the dispersing medium itself is cleaned and solid or liquid stains adhering to the inside of the tank or the dispersing chamber, or corner portions of the pipelines in which the liquid flows, can be completely removed by cleaning. Furthermore, it is easy to change the types or colors of products, such as a coating material, and it is possible to apply such method or apparatus to the production of various types of products and in small amounts.

We claim:

1. A dispersing method comprising the steps of: storing a dispersing medium and a liquid containing a material to be treated in a tank; drawing the dispersing medium and the liquid containing the material to be treated into a dispersing chamber by suction; moving the dispersing medium within the dispersing chamber to disperse the material to be treated in the liquid; discharging only the liquid containing the dispersed material from a discharge outlet of the dispersing chamber while separating the dispersing medium from the liquid containing the dispersed material; circulating the liquid containing the dispersed material to the tank; removing the dispersed material from the tank; feeding a cleaning liquid into the tank and drawing the cleaning liquid into the dispersing chamber by suction; and cleaning the tank and the dispersing chamber by permitting the dispersing medium to flow out of the dispersing chamber through the discharge outlet and to circulate together with the cleaning liquid through the tank and the dispersing chamber.

2. A dispersing method according to claim 1; wherein the step of drawing the cleaning liquid comprises rotating a plurality of rotary discs disposed in the dispersing chamber to generate suction to draw the cleaning liquid into the dispersing chamber.

3. A dispersing method according to claim 2; wherein during the discharging step the dispersing medium is separated from the liquid containing the dispersed material by a medium-separating device.

4. A dispersing method according to claim 3; wherein the medium-separating device comprises a filter disposed at the discharge outlet of the dispersing chamber; and wherein the separating step includes using the filter to allow only the liquid containing the dispersed material to be discharged from the discharge outlet of the dispersing chamber.

5. A dispersing method according to claim 4; including removing the filter from the discharge outlet of the dispersing chamber before the cleaning step to permit the dispersing medium to flow out of the dispersing chamber through the discharge outlet.

6. A dispersing method according to claim 1; wherein the step of drawing the dispersing medium comprises rotating a plurality of rotary discs disposed in the dispersing chamber to generate suction to draw the dispersing medium and the liquid containing the material to be treated into the dispersing chamber.

7. A dispersing method comprising the steps of: charging a dispersing medium and a liquid containing a material to be treated into a tank; drawing the liquid containing the material to be treated and the dispersing medium into a dispersing chamber by suction generated by rotation of at least one rotary disc disposed in the dispersing chamber; dispersing the material in the liquid within the dispersing chamber by movement of the dispersing medium caused by rotation of the disc; discharging the liquid containing the dispersed material through a discharge outlet of the dispersing chamber while separating the dispersing medium from the liquid containing the dispersed material and retaining the dispersing medium within the dispersing chamber; circulating the liquid containing the dispersed material to the tank through a pipeline which communicates the discharge outlet with the tank; and thereafter cleaning the tank, the dispersing chamber and the pipeline by permitting the dispersing medium to flow out of the dispersing chamber through the discharge outlet and to circulate together with a cleaning liquid through the tank, the dispersing chamber and the pipeline.

8. A dispersing apparatus comprising: a dispersing chamber; at least one rotationally driven disc disposed in the dispersing chamber; a suction inlet for drawing a dispersing medium and a liquid containing a material to be treated into the dispersing chamber by suction created by rotation of the disc; moving means for displacing the dispersing medium so as to disperse the material in the liquid; a discharge outlet for discharging from the dispersing chamber the liquid containing the dispersed material; medium-separating means disposed at an inner side of the discharge outlet for separating the dispersing medium from the liquid containing the dispersed material and permitting the liquid containing the dispersed material but not the dispersing medium to be discharged from the dispersing chamber; and means for cleaning the dispersing chamber by permitting the dispersing medium to circulate together with a cleaning liquid through the dispersing chamber.

9. A dispersing apparatus according to claim 8; wherein the moving means comprises the rotationally driven disc.

10. A dispersing apparatus according to claim 9; wherein the medium-separating means is detachably disposed at the inner side of the discharge outlet.

11. A dispersing apparatus according to claim 10; wherein the medium-separating means comprises a filter through which the liquid containing the dispersed material but not the dispersing medium may pass, and a holding frame for holding the filter, the holding frame being detachably disposed at an end of the discharge outlet.

12. A dispersing apparatus according to claim 11; wherein the filter is located along an inner face of the dispersing chamber when the holding frame is attached to the end of the discharge outlet.

13. A dispersing apparatus according to claim 8; further comprising a flow path through which the dispersing medium is permitted to pass, and closing means disposed at the inner side of the discharged outlet for selectively opening and closing the flow path.

14. A dispersing system comprising:

a storage tank for storing a dispersing medium and a liquid containing a material to be treated, the storage tank having an inlet port and an outlet port;

a dispersing apparatus having a dispersing chamber, at least one rotationally driven disc disposed in the dispersing chamber, a suction inlet for drawing the dispersing medium and the liquid containing the material to be treated from the storage tank into the dispersing chamber by suction created by rotation of the disc, moving means for displacing the dispersing medium so as to disperse the material in the liquid, a discharge outlet for discharging from the dispersing chamber the liquid containing the dispersed material, and medium-separating means disposed at an inner side of the discharge outlet for separating the dispersing medium from the liquid containing the dispersed material;

conduit means for connecting the suction inlet and the discharge outlet of the dispersing apparatus in fluid communication with the outlet port and the inlet port, respectively, of the storage tank; and means for circulating the dispersing medium together with a cleaning liquid through the storage tank, the dispersing chamber and the conduit means to clean the storage tank, the dispersing chamber and the conduit means.

15. A dispersing system according to claim 14; wherein the moving means of the dispersing apparatus comprises the rotationally driven disc.

16. A dispersing system according to claim 15; wherein the medium-separating means of the dispersing apparatus includes means for selectively discharging the liquid containing the dispersed material but not the dispersing medium.

17. A dispersing system according to claim 16; wherein the medium-separating means of the dispersing apparatus is detachably disposed at the inner side of the discharge outlet.

18. A dispersing system according to claim 17; wherein the medium-separating means of the dispersing apparatus comprises a filter through which the liquid containing the dispersed material but not the dispersing medium may pass, and a holding frame for holding the filter, the holding frame being detachably disposed at an end of the discharge outlet.

19. A dispersing system according to claim 18; wherein the filter is located along an inner face of the dispersing chamber when the holding frame is attached to the end of the discharge outlet.

20. A dispersing system according to claim 14; wherein the dispersing apparatus further comprises a flow path through which the dispersing medium is permitted to pass, and closing means disposed at the inner side of the discharged outlet for selectively opening and closing the flow path.

* * * * *